US008800576B2

(12) United States Patent
Chang

(10) Patent No.: US 8,800,576 B2
(45) Date of Patent: Aug. 12, 2014

(54) GUY STRUCTURE FOR AN AUTOMATIC UNFOLDING AND FOLDING UMBRELLA

(75) Inventor: Shumin Chang, Heyuan (CN)

(73) Assignee: ShengJing Technology (ShenZhen) Co., Ltd., Shenzhen (CN)

( * ) Notice: Subject to any disclaimer, the term of this patent is extended or adjusted under 35 U.S.C. 154(b) by 384 days.

(21) Appl. No.: 13/042,443

(22) Filed: Mar. 7, 2011

(65) Prior Publication Data

US 2011/0214704 A1 Sep. 8, 2011

(30) Foreign Application Priority Data

Mar. 8, 2010 (CN) ..... 2010 1 0139621

(51) Int. Cl.
*A45B 25/16* (2006.01)
*A45B 25/14* (2006.01)

(52) U.S. Cl.
CPC ..... *A45B 25/16* (2013.01); *A45B 25/14* (2013.01)
USPC ..... 135/24; 135/22; 135/25.1

(58) Field of Classification Search
CPC ..... A45B 25/14; A45B 25/16
USPC ..... 135/22–24, 25.1, 25.31, 25.34, 28, 40
See application file for complete search history.

(56) References Cited

U.S. PATENT DOCUMENTS 5,174,319 A * 12/1992 Chou et al. ..... 135/20.3
5,267,583 A * 12/1993 Wu ..... 135/24
5,803,102 A * 9/1998 Ko ..... 135/24
5,823,215 A * 10/1998 Chou et al. ..... 135/24
6,129,101 A * 10/2000 Dubinsky ..... 135/20.3
6,145,522 A * 11/2000 Ko ..... 135/24
6,173,722 B1 * 1/2001 Ko ..... 135/22
6,360,759 B1 * 3/2002 Lin et al. ..... 135/24
6,422,250 B1 * 7/2002 Wu et al. ..... 135/24
7,389,784 B2 * 6/2008 Kuo ..... 135/24
7,735,498 B2 * 6/2010 You ..... 135/24
7,789,096 B1 * 9/2010 Liu ..... 135/24
2005/0257817 A1 * 11/2005 Kuo ..... 135/24
2011/0132416 A1 * 6/2011 Ko ..... 135/20.3

* cited by examiner

*Primary Examiner* — Winnie Yip
(74) *Attorney, Agent, or Firm* — Dovas Law, P.C.

(57) ABSTRACT

A guy structure for an automatic unfolding and folding umbrella is provided. The guy structure includes two or more guys: One guy is a lower nest guy, provided at least between a middle rod and a lower nest; the other is an unfolding guy, provided at least between the middle rod and a spreading component in the umbrella head. While unfolding the umbrella, an unfolding spring stretches and opens part of the middle rod pipe. The unfolding guy pulls and opens the rest section of middle rod pipe with the cooperation of the lower nest guy, and forms the complete unfolding status. While folding the umbrella, the folding spring makes the lower nest move downward under force of the folding spring. At this time, the unfolding spring does not generate tension on the middle rod pipe above it, thus the middle rod pipe above the unfolding spring can be collected through the lower nest guy or the unfolding guy. Thereby, part of the middle rod pipe can be collected while folding the umbrella cover, so it can effectively shorten the middle rod length after folding the umbrella.

14 Claims, 14 Drawing Sheets

GUY STRUCTURE FOR AN AUTOMATIC UNFOLDING AND FOLDING UMBRELLA

TECHNICAL FIELD

Figure 1:
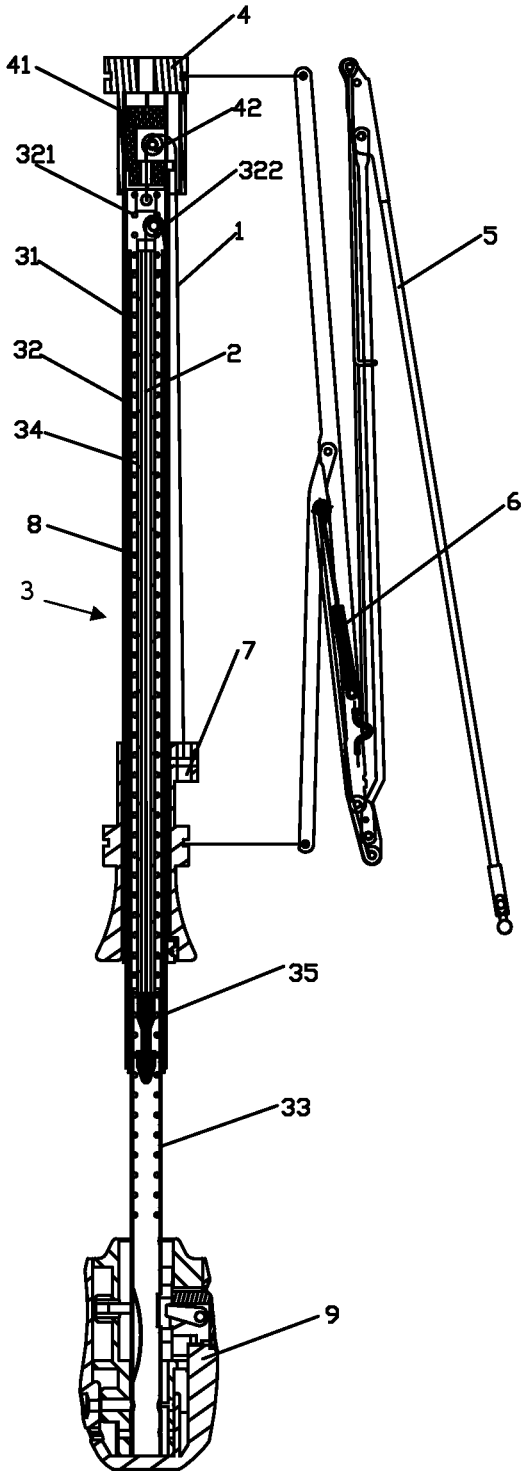

The present invention relates to a kind of automatic unfolding and folding umbrella, specifically, it relates to a guy structure for an automatic unfolding and folding umbrella. The guy structure can automatically collect part of the middle rod while folding the umbrella and shorten the umbrella length of in folding status.

BACKGROUND ART

The automatic umbrella is also called the automatic unfolding and folding umbrella, which is a kind of umbrella with the umbrella cover being automatically unfolded and folded by the unfolding spring and the folding spring. The automatic umbrella is easy for people to control and operate, because it can automatically unfold and fold the umbrella cover only by pushing down the button at the handle. Moreover, it needs no manual operation while folding the umbrella, so rainwater is unlikely to be splashed on people.

However, the folding in the conditions described above can automatically perform the action of collecting the umbrella cover. But, to realize the purpose of complete folding, the middle rod also must be pressed into the handle (umbrella head); otherwise it cannot be used next time. At this time, because the middle rod of the umbrella is completely opened, the umbrella is longer in length, and the travel required for pressing is longer, and larger strength is required to press the middle rod into the umbrella head. With regard to the aged and the weak, this operating method has certain difficulty, and there is a certain inconvenience involved with this kind of automatic unfolding and folding umbrella.

Consequently, it is necessary to improve the structure of the automatic umbrella described above, so as to fulfill the requirement of people for the folding umbrella.

SUMMARY OF THE INVENTION

It is discovered through studies that a guy is provided in the automatic unfolding and folding umbrella. One end of the guy is connected to the bullet head, the other end is wound and tied on the upper nest and the lower nest, and then is fixed on the upper nest or back on the lower nest after bypassing the upper nest. This guy is used only for control of the folding and unfolding the umbrella cover. If one conducts improvements on the guy, and make it fold while pulling a section of middle rod pipe, thus it can complete part of the folding work of the middle rod while folding the umbrella cover.

Therefore, the first purpose of the present invention is to provide a kind of guy structure for the automatic unfolding and folding umbrella. This structure can fold at least a part of the middle rod while folding the umbrella cover, so it can effectively shorten the umbrella length in folding status, and be convenient for people to press the middle rod into the umbrella head.

The other purpose of the present invention is to provide a kind of guy structure for the automatic unfolding and folding umbrella. This structure, through providing at least two independent guys, uses the movement relationship between the guys and the middle rod, so as to realize the effect of folding at least a part of the middle rod.

Another purpose of the present invention is to provide a kind of guy structure for the automatic unfolding and folding umbrella. This structure changes the arrangement method of the unfolding spring, and it can reduce the length of the unfolding spring and save resources.

Base on these reasons, the present invention is realized by this method:

A kind of guy structure for the automatic unfolding and folding umbrella is characterized in that: the guy structure includes at least two guys. The one guy is the lower nest guy, and the one is the unfolding guy. One end of the lower nest guy is at least connected to the lower nest. After the other end is wound and tied to the middle rod, it is at least connected on the middle rod pipe to be collected. The one end of the unfolding guy is at least connected to the spreading component controlling the unfolding and folding umbrella, and the other end is connected on the middle rod or the upper nest.

One end of the lower nest guy is connected to the lower nest. The other end moves upward and bypasses the upper nest, and then it is connected to the middle rod pipe, which is in the middle rod and can move relative to the upper nest. The unfolding spring is provided below the fixing section of the lower nest guy and the middle rod pipe. One end of the unfolding guy is connected on the spreading component, and goes upward through part of the middle rod pipe, and the other end is connected to the pipe or the upper nest above the fixing position of the lower nest guy.

Through this arrangement method, when the umbrella is unfolded, the unfolding spring will stretch, and open part of the middle rod pipe. Due to the function of the unfolding guy, the unfolding guy can pull and open the rest section of the middle rod because of the cooperation of the lower nest guy; it will open the middle rod and form the complete unfolding status. Because the unfolding spring is not provided in all the middle rod pipes, it makes the lower nest move downward due to the function generated by the folding spring while folding umbrella. The unfolding spring does not generate tension on the middle rod pipe above it, thus the middle rod pipe above the unfolding spring can be collected through the lower nest guy or the unfolding guy Thereby, part of the middle rod pipe can be folded while folding the umbrella cover, so it can effectively shorten the middle rod length after folding the umbrella.

In the guy structure, the lower nest guy acts on the lower nest and the pipes moving relative to the lower nest. The unfolding guy acts on the spreading component and the middle rod pipe. It is necessary to point out that the spreading component is not necessarily installed in the umbrella head, but it must be controlled by the umbrella head. It can also be installed in the inner stopper of the middle rod, provided that it can trip it. The acting method is realized through connection, and the connecting method can be any of the binding, knot and buckle, lap joint and trip. Its purpose is to create the application point between lower nest and the pipe moving relative to the lower nest. The preferred reliable method is: the one end of the lower nest guy is connected to the lower nest. The other end moves upward and bypasses the upper nest, then is connected to the middle rod pipe which is in the middle rod and can move relative to the upper nest. The one end of the unfolding guy is fixed on the spreading component installed in the umbrella head, and the other end is led out upward, and then is fixed on the pipe above the middle rod pipe, pushed and opened by the unfolding spring. An inner chock is provided on the pipe top fixing the lower nest guy, and it is used for fixing the lower nest guy. Of course, the lower nest guy can also be directly fixed on the pipe wall, but such method is adverse to the installation.

A kind of concrete embodiment is: the one end of the lower nest guy stretches out after it is connected to the lower nest, and then it is fixed on the upper nest, or on the outmost pipe of the middle rod which is fixed together with the upper nest. The other end stretches out after it is connected to the middle rod pipe which can move relative to the upper nest, and then is fixed on the upper nest or on the outmost pipe of the middle rod, which is fixed together with the upper nest. To sum up, during the movement process of the lower nest guy and the unfolding guy, the movement of the lower nest guy exposed outside the middle rod can be balanced with the rise and fall actions of the unfolding guy in the middle rod, and when the folding length of the middle rod is released. Only in this way can it realize the effect of folding part of the middle rod pipe.

The spreading component with the bullet head is any of the pulling comb and gripping head with reeling and unreeling functions. The spreading component is the component for controlling and collecting the umbrella cover in the existing automatic unfolding and folding umbrella, and it needs no improvement. It can be realized by adopting any one of the existing structure forms.

The lower nest guy is generally fixed on the second pipe from the top, so as to fold the first pipe of the middle rod while collecting the umbrella cover. For an embodiment where a middle rod with four pipes or more than four pipes is provided, a plurality of lower nest guys can be provided. For example, two lower nest guys can be provided for four pipes. The first and second lower nest guys can fold the two pipes of the middle rod while folding the umbrella cover. With regards to the conditions with the lower nest guys described above, they can be analogized. The one end of first lower nest guy is fixed on the lower nest, and the other end is fixed on the second pipe top after winding and tying the upper nest. The one end of the second lower nest guy is fixed below the first pipe, and the other end is connected on the third pipe top after winding and tying through the second pipe top. It can be analogized for the middle rod structure with four pipes and more. It can realize the effects of folding part of the middle rod by using the form of providing several lower nest guys. The pulling and tying between the previous pipe and the next pipes realized by relying on the lower nest guy; the unfolding guy also has the auxiliary function of the pulling and tying. The arrangement of the lower nest guys between pipes is the same as the arrangement method of the second lower nest guy in the four pipes. It can be analogized for the conditions with two or more lower nest guys.

When there are no twists existing in the lower nest guy and the unfolding guy, the lower nest guy is fixed on the one end of the pipe. It can be fixed on any position of the pipe, and is not restricted to the pipe top.

The present invention has the following advantages through the structure above:

1. While folding umbrella, it can automatically fold part of the middle rod pipe, and shorten the umbrella length in folding status.

2. The unfolding spring does not need to be provided in all the middle rod pipes; the length of the unfolding spring is shorter, so it can save resources and reduce cost.

3. The structure is simple, compact, and easy to be processed and manufactured.

4. It provides more safety.

DESCRIPTIONS OF ATTACHED FIGURES

Figure 3:
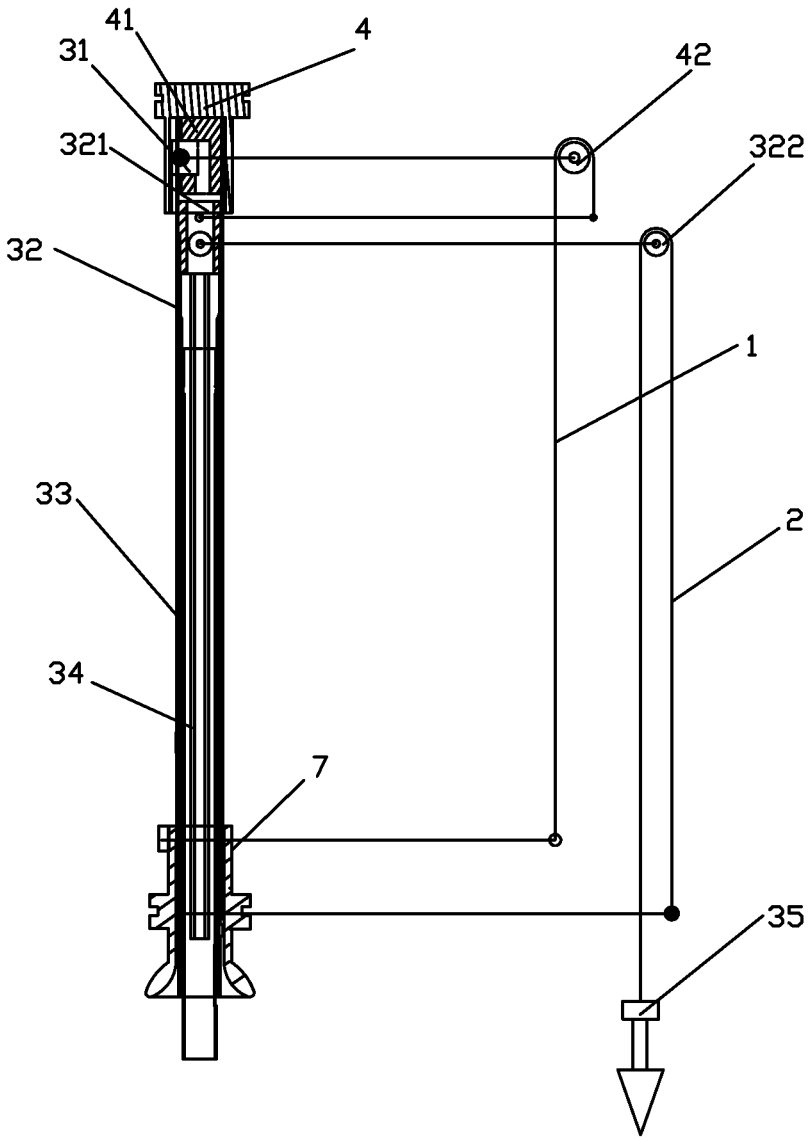

FIG. 1: The structure schematic figure of embodiment 1 in the present invention FIG. 2: The exploded view of the method as shown in FIG. 1;

FIG. 3: The guy position schematic figure while folding umbrella in the method as shown in FIG. 1.

Figure 4:
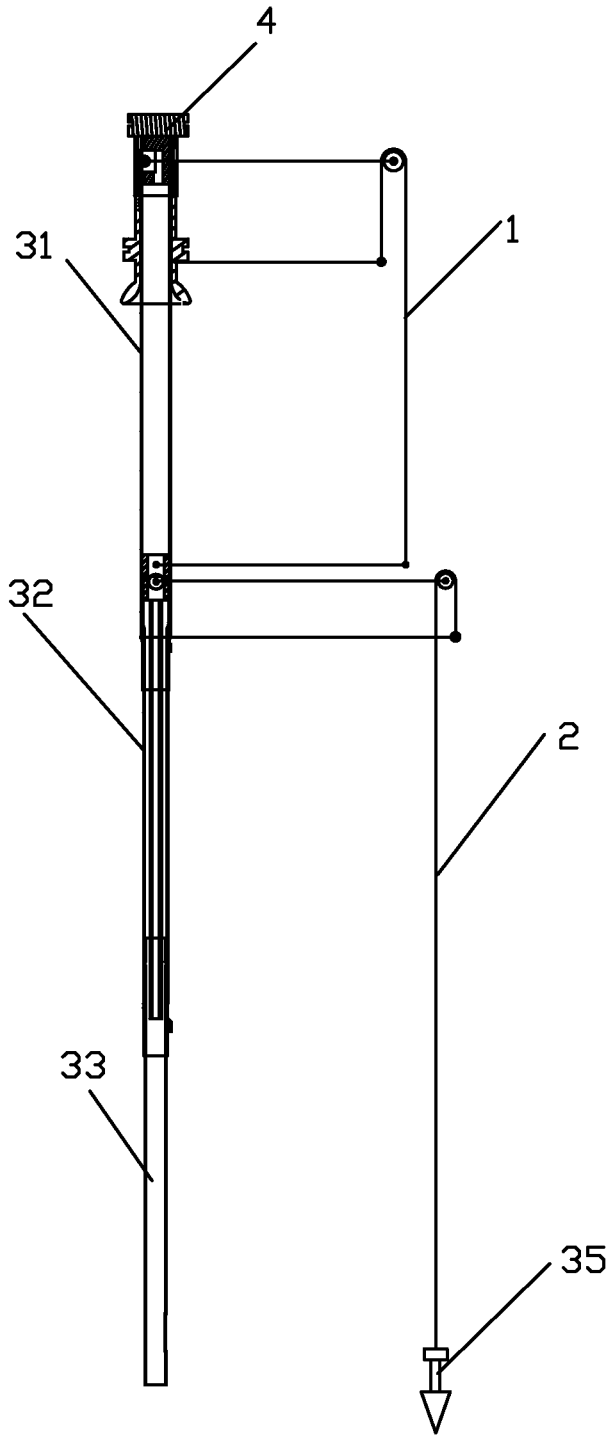

FIG. 4: The guy position schematic figure while unfolding umbrella in the method as shown in FIG. 1.

Figure 5:
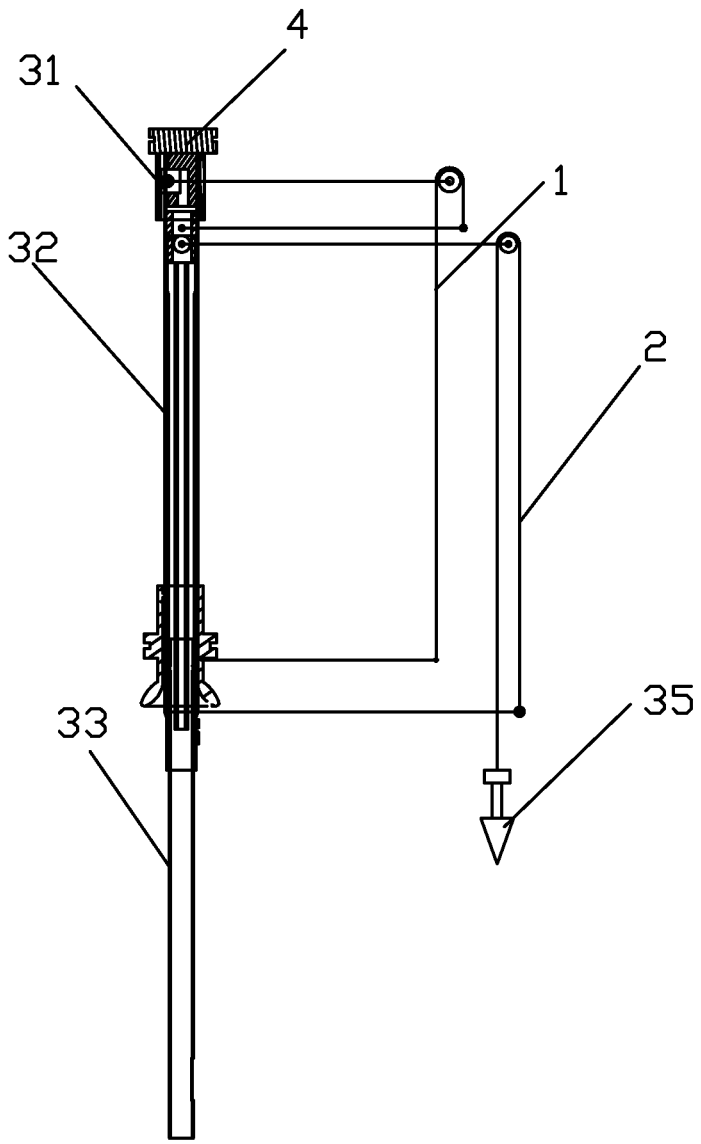

FIG. 5: The guy position schematic figure in folding status in the method as shown in FIG. 1.

Figure 7:
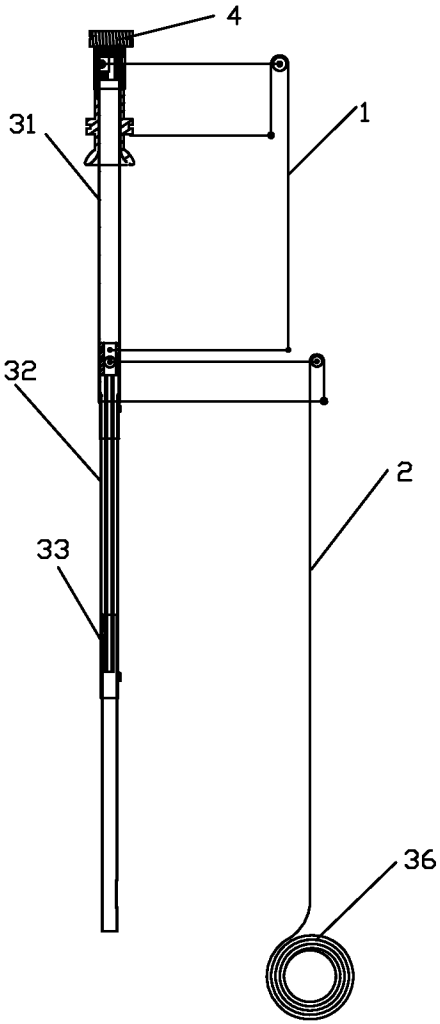
Figure 6:
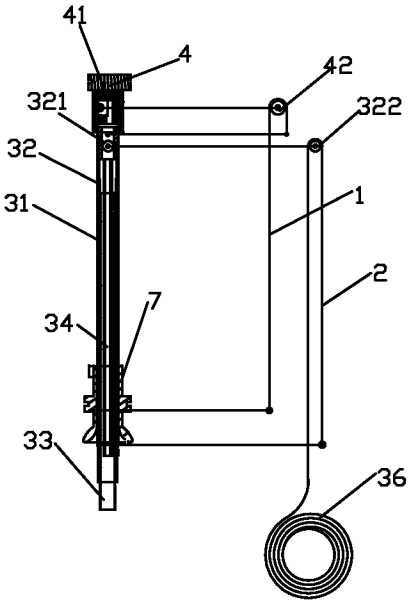

FIG. 6: The guy position schematic figure of embodiment 2 in the present invention;

FIG. 7: The guy position schematic figure in unfolding status in the method as shown in FIG. 6.

Figure 8:
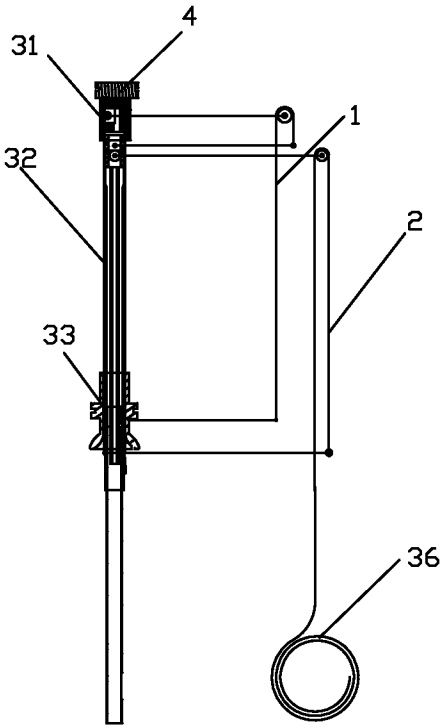

FIG. 8: The guy position schematic figure in folding status in the method as shown in FIG. 6.

Figure 10:
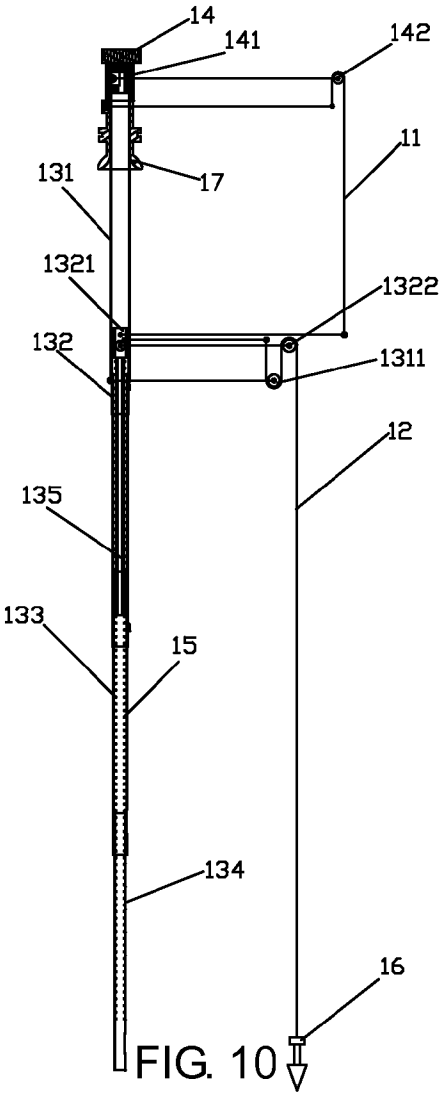
Figure 9:
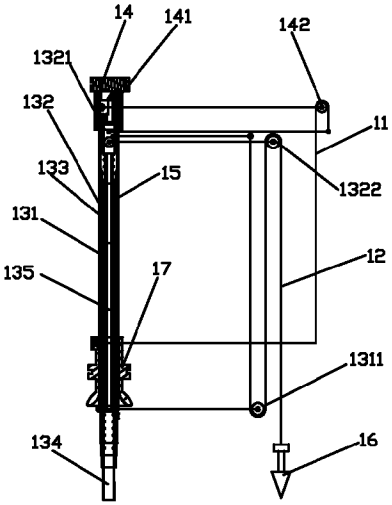

FIG. 9: The guy position schematic figure of embodiment 3 in the present invention;

FIG. 10: The guy position schematic figure in unfolding status in the method as shown in FIG. 9.

Figure 11:
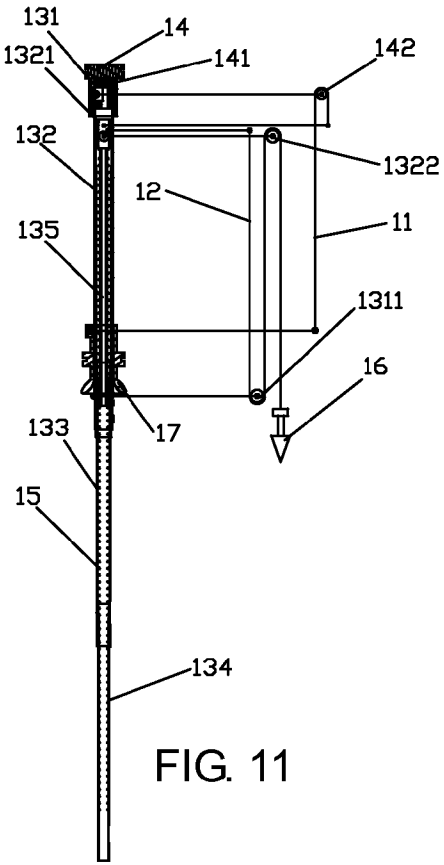

FIG. 11: The guy position schematic figure in folding status in the method as shown in FIG. 9.

Figure 13:
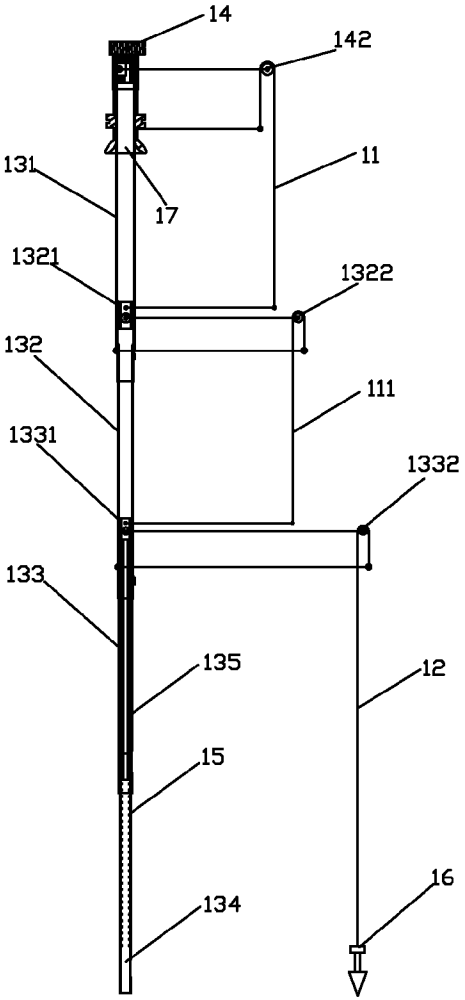
Figure 12:
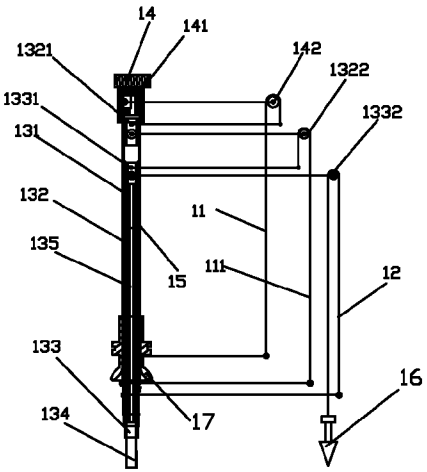

FIG. 12: The guy position schematic figure of embodiment 4 in the present invention;

FIG. 13: The guy position schematic figure in unfolding status in the method as shown in FIG. 12.

Figure 14:
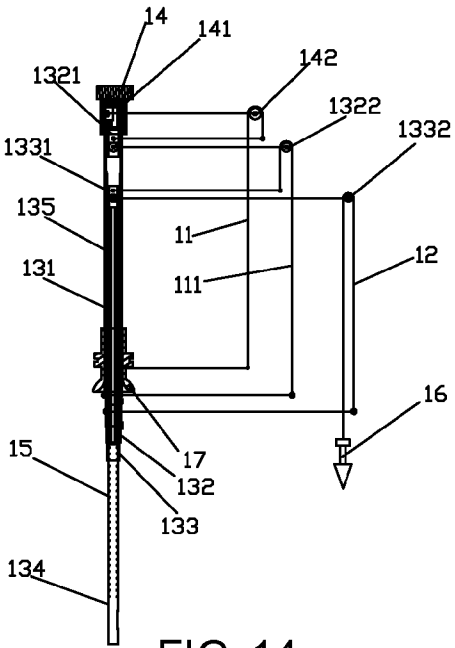

FIG. 14: The guy position schematic figure in folding status in the method as shown in FIG. 12.

Figure 16:
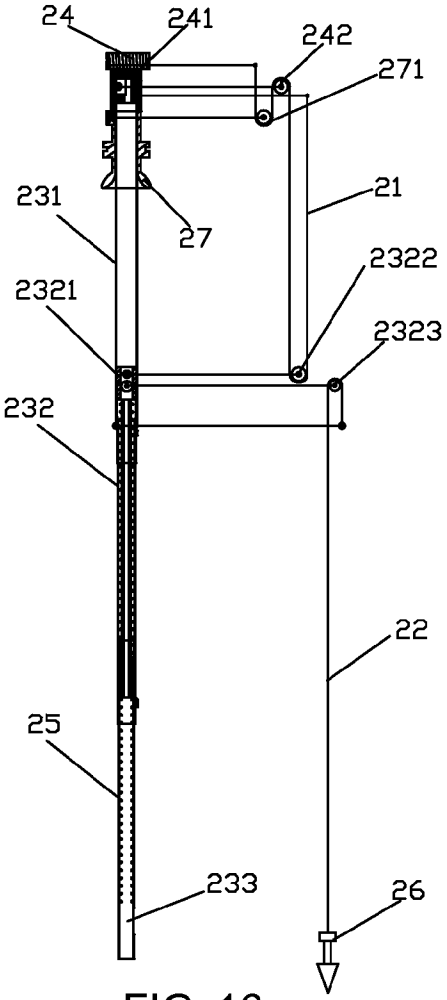
Figure 15:
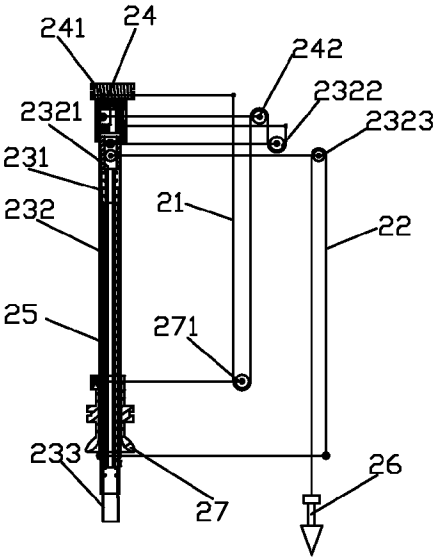

FIG. 15: The guy position schematic figure of embodiment 5 in the present invention;

FIG. 16: The guy position schematic figure in unfolding status in the method as shown in FIG. 15.

Figure 17:
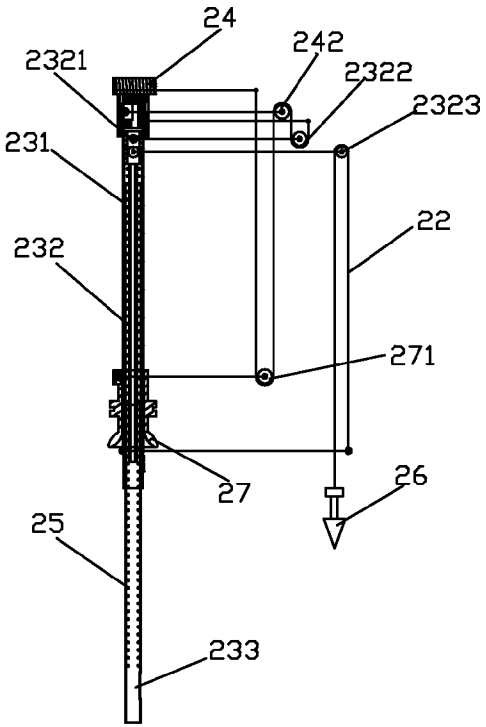

FIG. 17: The guy position schematic figure in folding status in the method as shown in FIG. 15.

Figure 19:
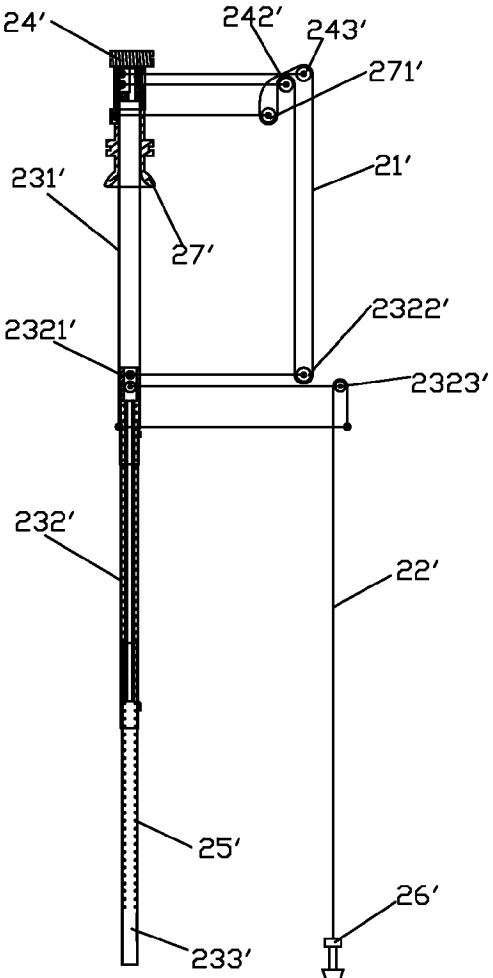
Figure 18:
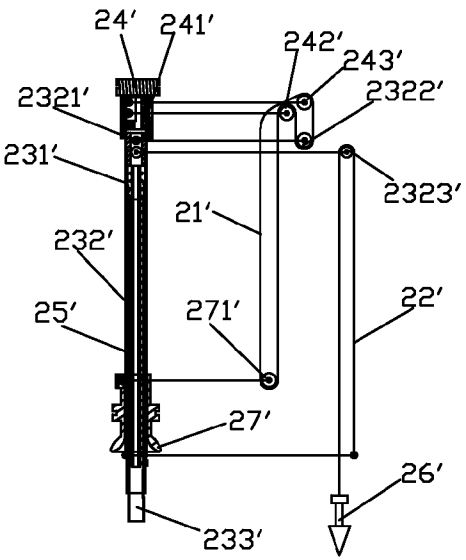

FIG. 18: The guy position schematic figure of embodiment 6 in the present invention;

FIG. 19: The guy position schematic figure in unfolding status in the method as shown in FIG. 18.

Figure 20:
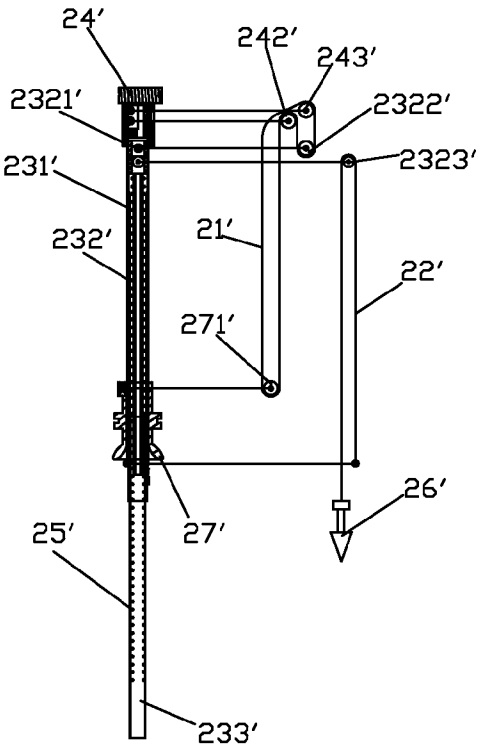

FIG. 20: The guy position schematic figure in folding status in the method as shown in FIG. 18.

Figure 23:
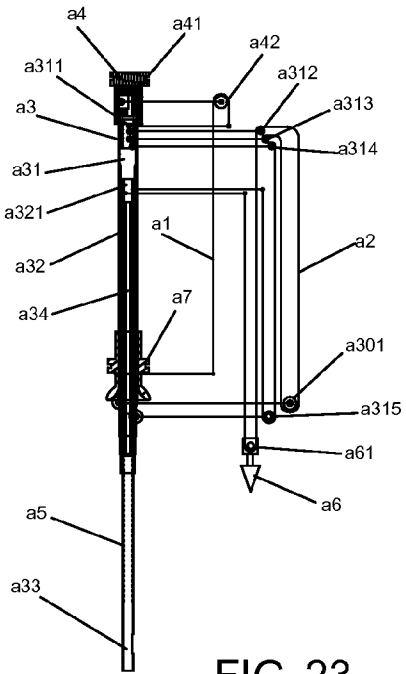
Figure 22:
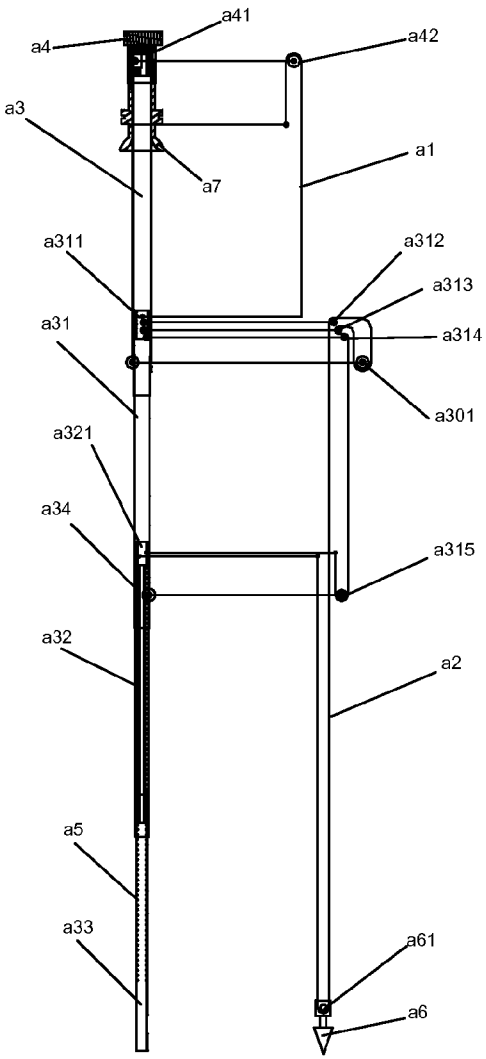
Figure 21:
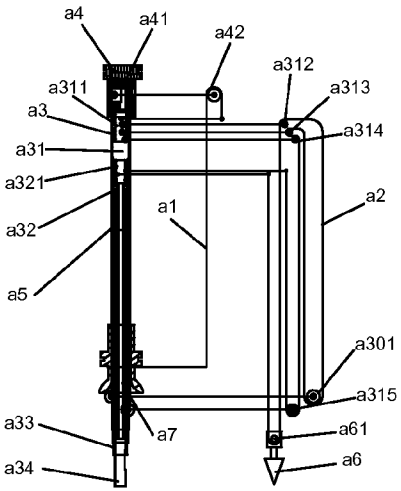

FIG. 21: The guy position schematic figure of embodiment 7 in the present invention;

FIG. 22: The guy position schematic figure in unfolding status in the method as shown in FIG. 21;

FIG. 23: The guy position schematic figure in folding status in the method as shown in FIG. 21.

Figure 26:
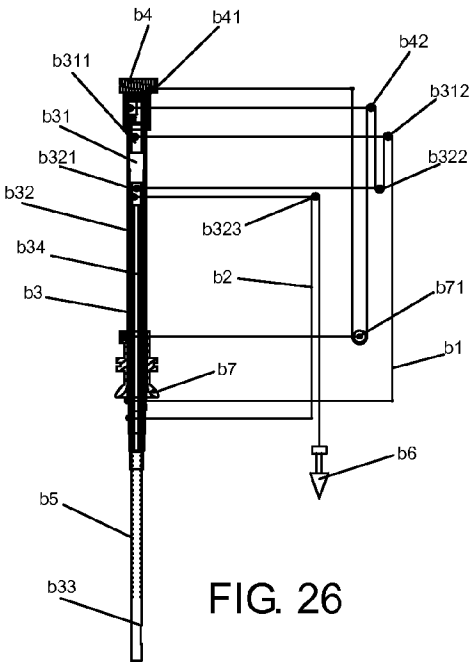
Figure 25:
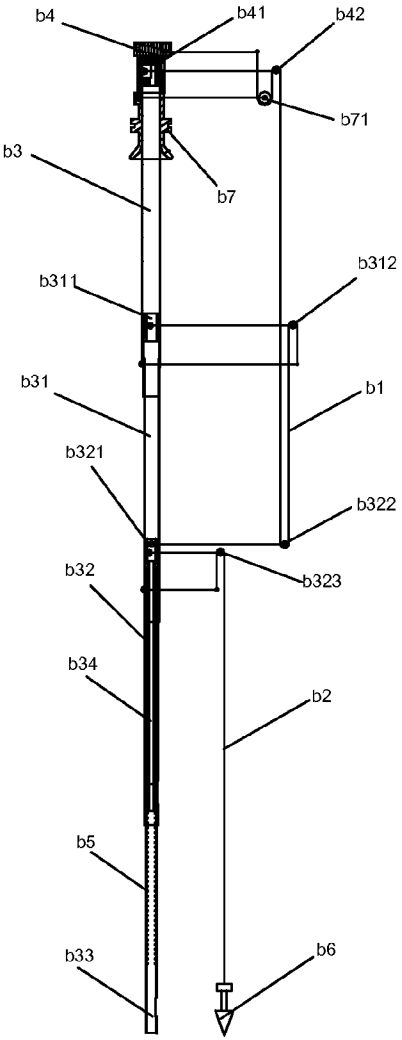
Figure 24:
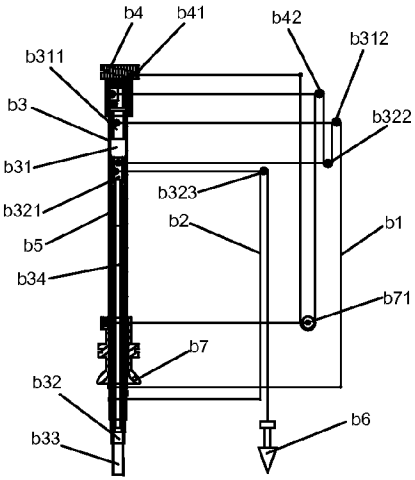

FIG. 24: The guy position schematic figure of embodiment 8 in the present invention;

FIG. 25: The guy position schematic figure in unfolding status in the method as shown in FIG. 24;

FIG. 26: The guy position schematic figure in folding status in the method as shown in FIG. 24.

Figure 29:
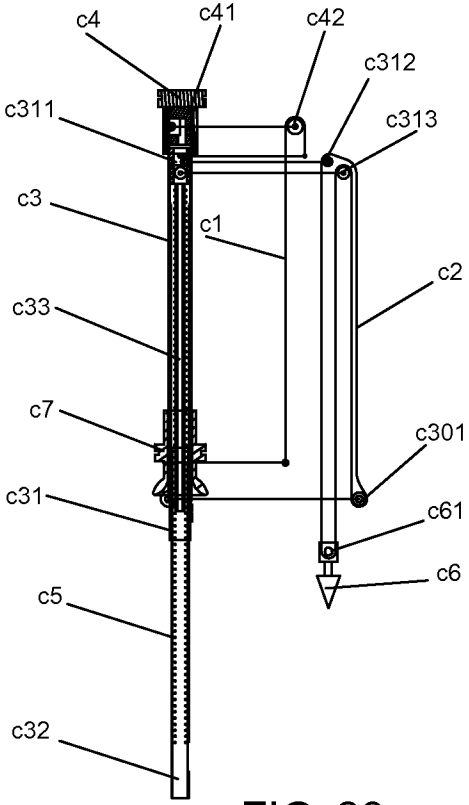
Figure 28:
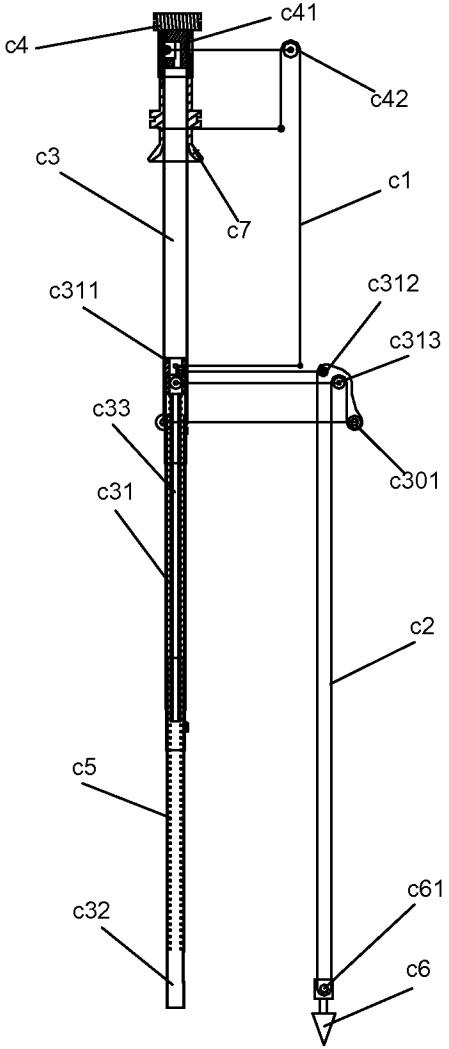
Figure 27:
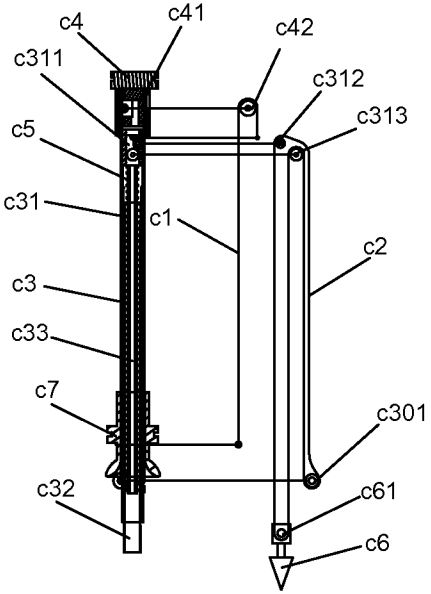

FIG. 27: The guy position schematic figure of embodiment 9 in the present invention;

FIG. 28: The guy position schematic figure in unfolding status in the method as shown in FIG. 27;

FIG. 29: The guy position schematic figure in folding status in the method as shown in FIG. 27.

Figure 31:
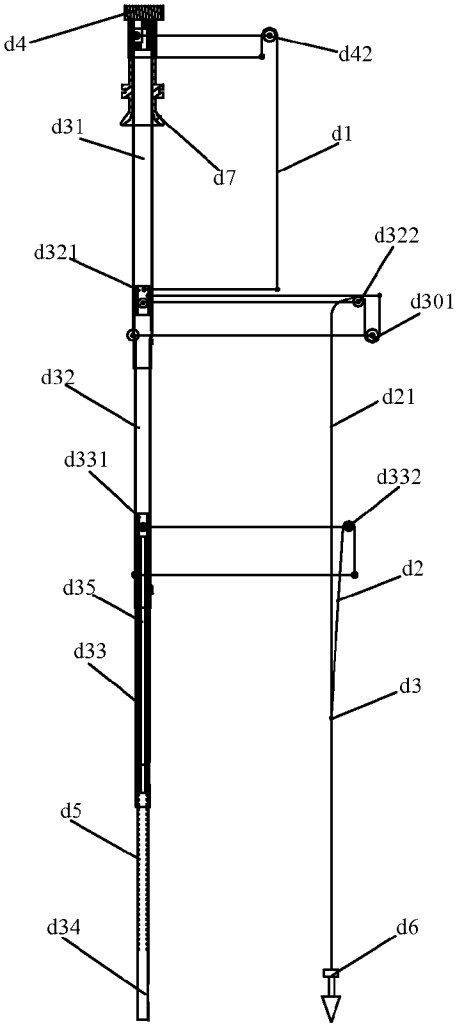
Figure 30:
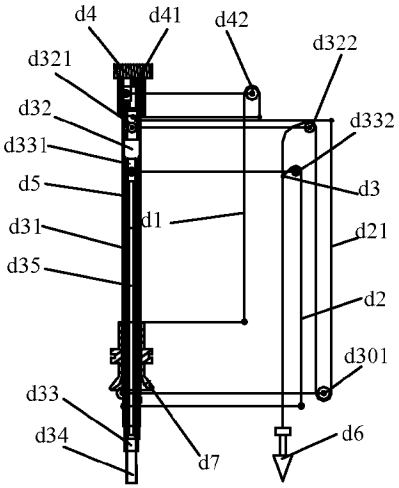

FIG. 30: The guy position schematic figure of embodiment 10 in the present invention;

FIG. 31: The guy position schematic figure in unfolding status in the method as shown in FIG. 30.

Figure 32:
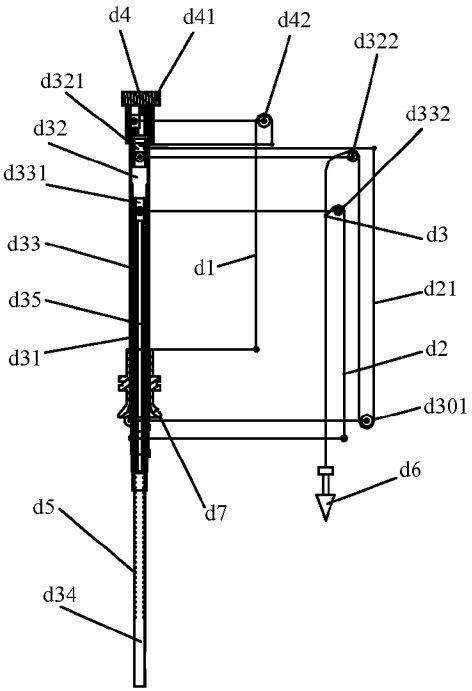

FIG. 32: The guy position schematic figure in folding status in the method as shown in FIG. 30.

DETAILED DESCRIPTION OF THE EMBODIMENTS

The main features of the present invention lie in providing at least two guys: The lower nest guy and the unfolding guy. Moreover, the two guys maintain the movement of the balance during the process of unfolding and folding umbrella, thus it realizes the effect of folding part of the middle rod.

Detailed description of the embodiments of the present invention is shown as follows in the aspects of the guy providing and embodiments.

Figure 2:
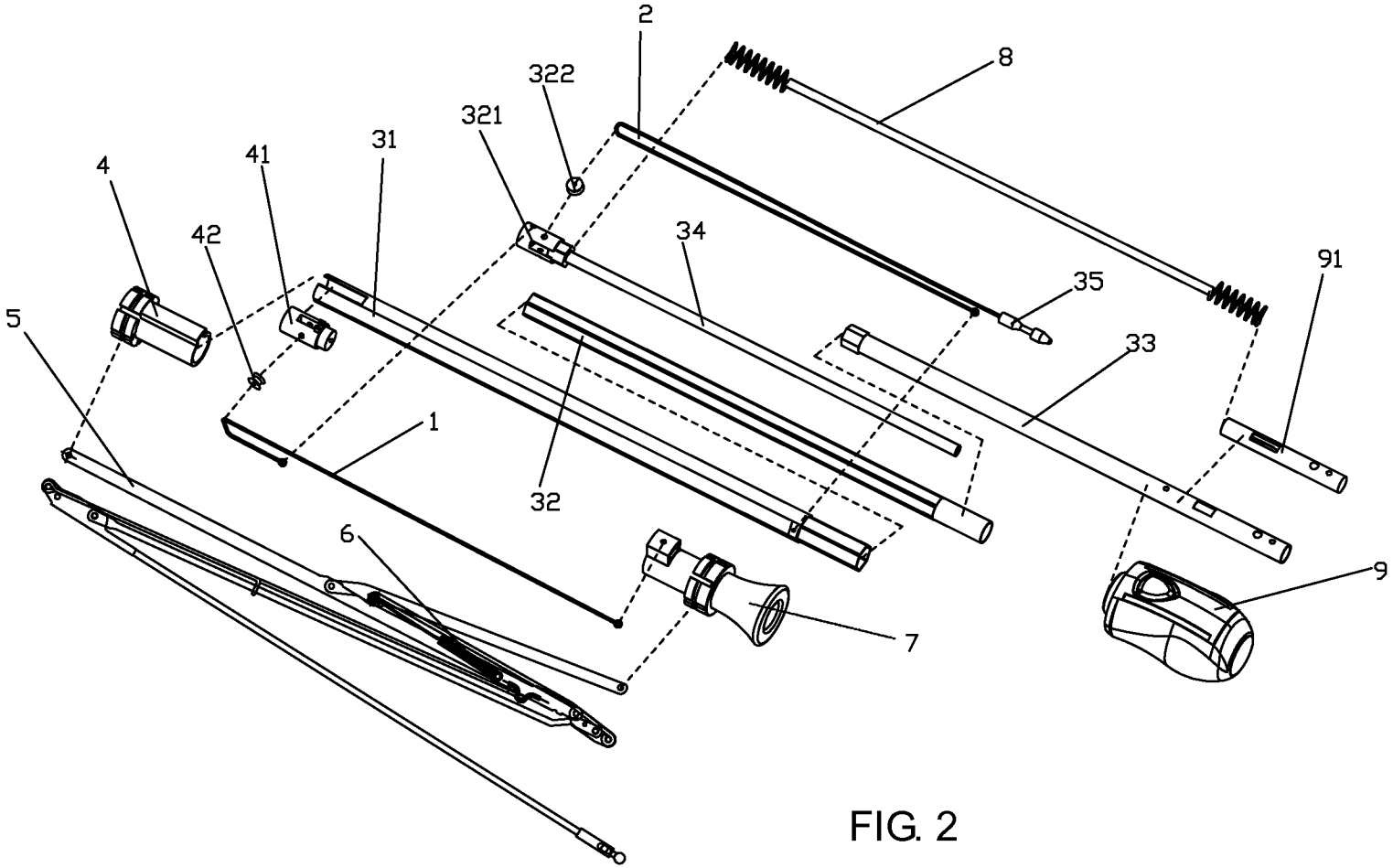

FIG. 1 is the assembly drawing when the present invention is used in a three-fold automatic unfolding and folding umbrella. FIG. 2 is the exploded view of FIG. 1. As to the components shown in the figure, except for the structure of the guy and unfolding spring, the rest of the structure is consistent with the components in an existing three-folded automatic unfolding and folding umbrella. That is to say, the present invention does not provide large changes in the structure and position relationship of the umbrella head 9 (including bullet head cover 91), bullet head 35, ribs 5, folding spring 6, middle rod 3 (including outer pipe 31, middle pipe 32 and inner pipe 33), upper nest 4 and lower nest 7. The key improvements lie in the providing of the lower nest guy 1, the unfolding guy 2 and the unfolding spring 8. One of the features of the present invention is the improvement of changing the one guy, which is used only for the control of the bullet head movement, into two guys. The one guy is the lower nest guy 1, and the other is the unfolding guy 2. One end of the lower nest guy 1 is connected to the lower nest 7. Through the outside of the outer pipe 31, it is wound and tied on the upper nest pulley 42 of the upper nest inner chock 41. Then it passes through the inside of the outer pipe 31, and is connected to the top of the middle pipe 32. There exist various methods for connecting the lower nest guy 1 to the middle pipe. For example, the lower nest guy 1 can be directly tied on the wall of the middle pipe 32 (in principle, it can be tied on any position of the middle pipe 32); or the lower nest guy 1 can pass through the holes perforated on the middle pipe 32 and knot for fixation, etc. As shown in the figure, it uses the method of providing the middle pipe inner chock 321, and the lower nest guy 1 is directly tied on the top of the middle pipe inner chock 321. This taking into consideration the process in actual use, it will not affect the umbrella on appearance and overall structure if the guys are provided in the middle rod. Moreover, the middle rod 3 is provided with a plastic sleeve 34, so as to restrain the guy connecting to bullet head 35 from interfering with unfolding spring 8, and thereby controlling the movement length of the bullet head. Therefore, the features above are integrated into the arrangement of the middle pipe inner chock 321. The plastic sleeve 34 can be positioned by embedding it into the middle pipe inner chock 321 from its bottom. The lower surface of the middle pipe inner chock 321 reaches the position, where it can either contract or restrain the unfolding spring 8. Thus, it is enough to provide the unfolding spring 8 only in the middle pipe 32 and the inner pipe 33.

The main function of the unfolding guy 2 is still the same as the function of the existing automatic unfolding and folding umbrella. Therefore, the one end of the unfolding guy 2 is still connected to the bullet head 35. Then, the unfolding guy 2 passes through the plastics sleeve 34, and stretches out of the middle pipe 32 through the pulley 322 provided in the middle pipe inner chock 321, and then it is fixed on the lower part of the outer pipe 31 through the inside of the outer pipe 31.

Thus, it can control the position and unfolding of middle rod 3 and pipe 31 respectively through the lower nest guy 1 and the unfolding guy 2, and thus the purpose of the present invention can be realized. While unfolding the umbrella, pushing the button on umbrella head 9 releases the trigger of the middle rod 3; and then the unfolding spring 8 will stretch, and open the middle pipe 32. Then the unfolding guy 2 pulls and opens the outer pipe 31. Because the outer pipe 31 is opened, most of the lower nest guy 1 is held in the outer pipe 31, and then the lower nest guy 1 pulls the lower nest 7 upward, and forms the unfolding actions. While folding the umbrella, pushing the button again, releases the trigger of the bullet head 35. Due to the function of the folding spring 6, the umbrella ribs 5 are collected, and it pushes the lower nest 7 to move downward, and the bullet head 35 is bounced out. The pulling and tying function of the unfolding guy 2 on the outer pipe 31 disappears. Because the lower nest 7 moves downward, the lower nest guy 1 is pulled out of the outer pipe 31. Consequently, it causes that the outer pipe 31 to move downward and be collected on the middle pipe 32. At this point, the pulling force of the folding spring 6 is offset by the tensile force of unfolding spring 8, and it forms a status of collecting not only the umbrella cover and ribs but also the outer pipe 31.

Referring to FIG. 3-FIG. 5, the location and movement relationship of the lower nest guy 1 and the unfolding guy 2 is presented. As shown in the FIG. 3, while the umbrella is in the folding status, the one end of the lower nest guy 1 is connected to the lower nest 7. At this point the lower nest 7 is located at the lower part of the outer pipe 31. Then, the other end of the lower nest guy 1 bypasses the upper nest pulley 42 in the upper nest inner chock 41, and is fixed on the top of the middle pipe inner chock 321. The middle pipe inner chock 321 is located at the top in the outer pipe 31. Most of the lower nest guy 1 is pulled out, and is located outside of the outer pipe 31. The one end of the unfolding guy 2 is connected to the bullet head 35. The bullet head 35 is held within the umbrella head 9 by the bullet head cover 91 and other components. The other end passes through the plastic sleeve 34, and then through the pulley 322 provided in the middle pipe inner chock 321, and it is connected to the lower part of the outer pipe 31. The tensile force of the unfolding spring 8 is suppressed by the middle rod, while the folding spring 6 is in the status of tightening the umbrella ribs and collecting the umbrella cover;

While unfolding umbrella, pushing the button of the umbrella head 9, due to the function of the unfolding spring 8, the middle pipe 32 is bounced open, and the bullet head 35 is still stuck. Because of the pulling and tying of the unfolding guy 2, the outer pipe 31 moves upward. Most of the unfolding guy 2 is located in the middle pipe 32 and inner pipe 33. Meanwhile, because of the rising of the outer pipe 31, it makes the distance between the upper nest 4 and the middle pipe inner chock 321 increase. The lower nest guy 1 drives the lower nest 7 to move upward until the unfolding status is completed. As shown in FIG. 4, at this point, most of the lower nest guy 1 is located in the outer pipe 31. The unfolding spring 8 is opened, and the tensile force of the folding spring 6 is offset.

While folding umbrella, pushing the button of the umbrella head 9, releases the trigger of the bullet head 35. The pulling and tying function of the unfolding guy 2 on the outer pipe 31 disappears. Due to the function of the folding spring 6, the umbrella ribs 5 are collected, and this pushes the lower nest 7 to move downward until the lower nest 7 reaches the lower part of the outer pipe 31. Due to the lower nest 7 moving downward, the lower nest guy 1 is pulled out of the outer pipe 31. Consequently, it forms an upward pulling force on the middle pipe 32. While the middle pipe 32 is stretched open by the unfolding spring 8, and the assembly type of the middle rod is of beam pipe, no movement or dislocation can happen there. This forms a counterforce, which pulls the outer pipe 31 move downward, and realizes the effect of collecting the outer pipe 31 into the middle pipe 32. The unfolding guy 2 also moves downward with the outer pipe 31, and part of it is located inside of the outer pipe 31.

During the process of the unfolding and folding the umbrella, the lower nest guy 1 is in the tightening status, so as to form the pulling and tying relationship to the middle pipe 32 and the lower nest 7. Likewise, the unfolding guy 2 is also basically in the tightening status, so that it can pull out the outer pipe 31 and maintain the coordination of position. During this function process, while collecting the umbrella ribs 5, the outer pipe 31 is also collected in the middle pipe 32 simultaneously. It has either the folding action of the existing automatic unfolding and folding umbrella or the effect of collecting part of the middle rod. So it is convenient for people to realize the folding of the umbrella, and it is easy to control.

In conclusion, regardless of which type of unfolding and folding method or guy arrangement method, While unfolding and folding the umbrella, the lower nest guy while folding the umbrella shall generate downward pulling force on the pipes folded, so as to make the pipes folded conduct movement and reach the folded position. While unfolding the umbrella, the unfolding guy shall pull up the complete length of the linked pipes, and the movement of the lower nest guy and the unfolding guy shall be kept in balance. This can guarantee the automatic folding of the pipes. Regardless whether it is a the three-folded, four-folded or even the five-folded automatic unfolding and folding umbrella, it is arranged in such a manner.

FIG. 6-FIG. 8 depict the guy position and the structure schematic figure of embodiment 2 of the present invention. In this embodiment, compared with the method shown in FIG. 1 and FIG. 2, the only difference is the spreading component in the umbrella head 9 for control of the unfolding and folding umbrella. The other components, such as the guy arrangement method, are the same. Therefore it is described only with the guy position relationship figure. In the method shown in the FIG. 1 and FIG. 2, the spreading component for controlling the unfolding and folding umbrella is the bullet head (including the subsidiary accessories). However, this embodiment uses the windlass 36 (including the subsidiary accessories). Windlass 36 is a disk consisted of coil line similar to a tapeline, and the coil line can be elastically pulled out and folded. Likewise, the unfolding guy 2 is connected to the windlass 36 in this embodiment. Specifically, the unfolding guy 2 is directly connected to the coil line of the windlass disk 36.

In this structure method, it is usually necessary to fix the outer pipe 31 and the middle pipe 32 after folding them. Otherwise, it may cause the unfolding conditions, and the outer pipe is usually used to fasten the middle pipe.

In the method shown in the FIG. 6-FIG. 8, the arrangement method of the lower nest guy 1 and the unfolding guy 2 is the same as the method shown in FIG. 1. Namely, the one end of the lower nest guy 1 is connected to the lower nest 7. Through the outside of the outer pipe 31, it is wound and tied on the upper nest pulley 42 of the upper nest inner chock 41. Then it passes through the inside of the outer pipe 31, and is fixed in the middle pipe inner chock 321 on the top of the middle pipe 32. The one end of the unfolding guy 2 is connected to pulling disk 36, and then the unfolding guy 2 passes through the plastic sleeve 34, and stretches out of the middle pipe 32 through the pulley 322 provided in the middle pipe inner chock 321. It is then fixed on the lower part of the outer pipe 31 through the inside of the outer pipe 31.

Therefore, during the control process of unfolding and folding the umbrella, this embodiment is the same as shown in FIG. 1. It is unnecessary to repeat it again.

In a similar way, FIG. 9-FIG. 11 depict the guy position schematic figures when the present invention is implemented in the four-folded umbrella. Because the main structure of the four-folded umbrella has no changes, and local changes have taken place in the guy arrangement method and the middle rod, the guy position schematic figures can be used to express the invention content. As to the part with the same structure as the existing four-folded umbrella, it is unnecessary to repeat it again.

As shown in the FIG. 9-FIG. 11, the middle rod 13 consists of the outer pipe 131, the middle pipe one 132, the middle pipe two 133 and the inner pipe 134 in nested method with each other. The unfolding spring 15 is provided between the middle pipe one 132, the middle pipe two 133 and the inner pipe 134. The guy structures used in the four-folded umbrella include two guys: The lower nest guy 11 and the unfolding guy 12. The one end of the lower nest guy 11 is fixed on the lower nest 17; the other end goes upward and passes through the upper nest 14. Then it is wound into the outer pipe 131 through the upper nest pulley 142 provided in the upper nest inner chock 141, and is connected to the inner chock 1321 of the middle pipe one. The top of the middle pipe one 132 is furnished with the inner chock 1321 of the middle pipe one. The lower part of the inner chock 1321 is embedded with the plastic sleeve 135, and its bottom surface has the unfolding spring 15, and the inner chock 1321 is also provided with the pulley one 1322. Thus it forms the folding function on the outer pipe 131.

The one end of the unfolding guy 12 is connected to the bullet head 16, the other end passes through the plastic sleeve 135 which is fixed on the inner chock 1321 of the middle pipe one 132 and is provided in the middle pipe one 132. In other embodiments, it can use the method not to pass through the plastic sleeve 135, but it is more stable to use the method of passing through the plastic sleeve. Because two times the length of the middle rod pipe is released while unfolding the umbrella, the unfolding guy shall bypass the pulley one 1322, and bypass the pulley 1311 provided at the lower part of the outer pipe 131, and then connect to the inner chock 1321 at the upper part of the middle pipe one 132.

While unfolding the umbrella, the unfolding spring 15 opens, and makes the middle pipe one 132 and the middle pipe two 133 open. Meanwhile, the unfolding guy 12 pulls the outer pipe 131, and makes the outer pipe 131 open, too. While the middle pipe one 132, the middle pipe two 133 and the outer pipe 131 are opened, The lower nest guy 11 pulls the lower nest 17 to move upwards, and forms the unfolding status as shown in the FIG. 10.

While folding the umbrella, the bullet head 16 releases, and the pulling force of the unfolding guy 12 on the outer pipe 131 disappears. Due to the function of the folding spring, the lower nest 17 moves downward, thereby pulling the outer pipe 131 to move down. Finally, it folds the outer pipe 131 while folding the umbrella ribs and the umbrella cover, as shown in FIG. 11.

As to multiple telescopic umbrellas, especially the three-fold automatic unfolding and folding umbrella described above, the main purpose of the present invention is to provide at least two guys in the middle rod and umbrella head. In which, one guy is mainly used to fold the middle rod pipe (each pipe forming the middle rod is referred to as a pipe) of the middle rod while folding the umbrella. The other guy is mainly used to open the middle rod pipe to be folded while unfolding. Moreover, the unfolding spring cannot be provided in the pipe to be folded. Otherwise because of the support of the unfolding spring, it cannot fold this pipe, thus it can generate the effect of saving the unfolding spring.

As for the two guys, the lower nest guy mainly acts on the middle rod pipe to be folded by it, and makes the pipe to be folded into the other pipe while the folding spring contracts. As for the unfolding guy, first it shall pull the middle rod pipe to be folded by it, and open it while unfolding the umbrella; second, it shall provide sufficient guys to make other middle rod pipes be bounced open while unfolding the umbrella. Therefore, after the one end of the unfolding guy acts on the spreading component, such as the bullet head, etc., the other end acts on the middle rod pipe to be folded at the upper part of the middle rod pipe. If the middle rod pipes to be bounced open by the unfolding spring exceed one pipe, the unfolding guy can store sufficient guys through the wire winding method between the pipe and the other pipes. For example, if two pipes are bounced out while unfolding the umbrella, guys are required for winding two pipes. If three pipes are bounced out, guys are required for winding three pipes. In like manner, as to the connection of the unfolding guy and the bullet head or other spreading components, in one of the methods the unfolding guy can be fixed on the bullet head. In another method, the unfolding guy can be wound on bullet head or other spreading components, and then it stretches out, and is fixed on the other pipes or the upper nest. The lower nest guy can also co-ordinate the unfolding guy to generate the function of pulling the middle rod pipe for unfolding the umbrella through the arrangement method, so as to open the middle rod pipe. Likewise, when the unfolding guy folds the umbrella, it can also have the auxiliary function for folding the middle rods.

Moreover, it can then fold the pipes tied with the upper nest, and can also fold the pipes below this pipe, provided that the unfolding spring is not provided in the pipes folded. Thus, the four-folded automatic unfolding and folding umbrella can also be made for the automatic folding of two pipes, the outer pipe and the middle pipe one. In such cases, it is necessary to increase the guy arrangement of similar lower nest guys. The five-folded automatic unfolding and folding umbrella can be manufactured in the same way. The four-folded automatic unfolding and folding umbrella for example can be provided as follows.

As shown in the FIG. 12-FIG. 14, according to the method described in the present invention, the arrangement based on FIG. 9 includes three guys, where the functions and effects of the two upper guys are completely the same as the lower nest guy 11. To distinguish them, the one guy is the lower nest guy 11, and the other is the middle pipe guy 111. The unfolding guy 12 provided underneath has not changed in function, but its connection position has been changed, so as to reach the effect of folding two pipes.

As shown in the figure, the one end of the lower nest guy 11 is fixed on the lower nest 17, while the other end bypasses the upper nest pulley 142 in the upper nest inner chock 141, passes through the outer pipe 131, and is fixed on the inner chock 1321. The one end of the middle pipe guy 111, a guy similar to the lower nest guy, is fixed on the lower part of the outer pipe 131, bypasses the pulley one 1322, then passes through the middle pipe one 132, and connects with inner chock 1331 of the middle pipe two.

The middle pipe one 132 and the middle pipe two 133 have corresponding inner chocks. However, the inner chock 1331 in the middle pipe one is used to fix the lower nest guy 11 and arrange the pulley one. Besides the inner chock 1331 in the middle pipe two is used to fix the middle pipe guy 111 and provide pulley two 1332. Its bottom is embedded or fixed with the plastic sleeve 135, and the bottom surface of the inner chock 1331 in the middle pipe two has been supported with the unfolding spring 15.

At this point, the unfolding spring 15 is provided only in the middle pipe two 133 and inner pipe 134, but it is not provided in the middle pipe one 132 and the outer pipe 131, so that the middle pipe one 132 and the outer pipe 131 can be folded while folding the umbrella.

The one end of the unfolding guy 12 is connected to the bullet head 16, and the other end passes through the plastic sleeve 135 and pulley two 1332. Then it is connected to the lower part of the middle pipe one 132.

As shown in FIG. 13, while unfolding the umbrella, the unfolding spring 15 opens, and it bounces out the middle pipe two 133. Because the bullet head 16 is stuck, the unfolding guy 12 pulls the middle pipe one 132, and makes the middle pipe one 132 go up, and form the open status of the middle pipe one 132. Meanwhile, the rising of the middle pipe one 132 changes the position of the middle pipe one 132 and the middle pipe two 133, and the middle pipe guy 111 pulls the outer pipe 131 to move up. Likewise, the lower nest guy 11 also pulls the lower nest 17 to move up, and form the unfolding status.

While folding the umbrella, the bullet head 16 releases and the pulling effect of the unfolding guy 12 on the middle pipe one 132 disappears. Due to the acting force of the folding spring, the umbrella ribs will drive the lower nest 17 to move. The lower nest 17 moves down, then the lower nest guy 11 will drive the outer pipe 131 to be folded in the middle pipe one 132. Meanwhile, because the middle pipe one 132 moves, the middle pipe guy 111 will drive the middle pipe one 132 to move downward, thereby folding the middle pipe one 132, as shown in FIG. 14. Consequently, it can fold the two pipes: The outer pipe 131 and the middle pipe one 132. Thus, while folding the umbrella, the operating travel required is greatly shortened, and thus it is convenient for control. As to the existing prior art automatic umbrella, the very long middle rod has formed effect on other articles after folding the umbrella. However, this phenomenon will not appear in the present invention.

Because the guys have pulling and tying effects during the automatic unfolding and folding, the guys, including the lower nest guy, the middle pipe guy and the unfolding guy, can be composed of metal wire, plastic wire, nylon wire or any other wires with certain strength. But one of the basic requirements for the guys is to have sufficient strength, so that the pulling effects and coordination are smooth during the process of using the umbrella.

FIG. 15-FIG. 17 depicts the embodiment 5 of the present invention. Based on the structure as shown in FIG. 1, this embodiment improves the lower nest guy. It makes both the upper and lower end of the lower nest guy stretch out, and the lower nest guy is fixed on the upper nest. The lower nest guy can also be fixed on the outer pipe.

As shown in the FIG. 15, when the umbrella is in folding status, the one end of the lower nest guy 21 is connected to the lower nest 27. Namely, the lower nest pulley 271 is provided on the lower nest 27. Then the lower nest guy 21 passes through the lower nest pulley 271 and it is extended and fixed on the upper nest 24. The middle rod 23 includes three pipes: The outer pipe 231, the middle pipe 232 and the inner pipe 233, in which, the middle pipe 232 is provided with the middle pipe inner chock 2321 at the upper part. The middle pipe inner chock 2321 has the plastic sleeve fixed at its lower part. The middle pipe inner chock 2321 of the middle pipe 232 is provided with two pulleys. The upper pulley is the pulley one 2322 and the lower one is the pulley two 2323. Then, the other end of the lower nest guy 21 bypasses the upper nest pulley 242 in the upper nest inner chock 241, and then bypasses the pulley one 2322 again. It is led out upward and is fixed in the upper nest inner chock 241. The one end of the unfolding guy 22 is connected to and fixed on the bullet head 26. The other end passes through the middle pipe 232, and bypasses the pulley two 2323 in the middle pipe inner chock 2321, and it is fixed on and connected to the lower part of the outer pipe 231. This end of the unfolding guy 22 can also be fixed on the upper part of the outer pipe 231 or on the upper nest 24, and the function is the same.

While unfolding the umbrella, due to the function of the unfolding spring 25, the middle pipe 232 is bounced open. Because of the pulling of the unfolding guy 22, the outer pipe 231 moves upward. Most of the unfolding guy 22 is located in the middle pipe 232 and the inner pipe 233. Meanwhile, because of the rising of the outer pipe 231, it makes the distance between the upper nest 24 and the middle pipe inner chock 2321 increase. Although both ends of the lower nest guy 21 are fixed, because of the effects of the upper nest pulley 242 and the pulley one 2322, the lower nest guy 21 drives the lower nest 27 to move upward until the unfolding status occurs, as shown in FIG. 16.

While folding umbrella, the bullet head 35 releases, and the pulling effect of the unfolding guy 2 on the outer pipe one 31 disappears. Due to the function of the folding spring, the umbrella ribs are folded. They push the lower nest 27 to move downward until the umbrella ribs have been folded. At this point, the lower nest 27 reaches the lower part of the outer pipe 231. While lower nest 27 is moving downward, the lower nest guy 21 is pulled out of the outer pipe 231, and it forms an upward pulling force on the middle pipe 232 through the pulley one 2322. However, the middle pipe 232 is opened by the unfolding spring 8, so it cannot move. This forms a counterforce, which pulls the outer pipe 231 to move downward, and realizes the effect of collecting the outer pipe 231 into the middle pipe 232. As shown in FIG. 17, with the downward motion of the outer pipe 231, the unfolding guy 22 also releases part of the guy into the outer pipe 231, and realizes the balance effects of the unfolding guy 22 and the lower nest guy 21.

FIG. 18-FIG. 20 represent the guy position and the structure schematic figure in embodiment 6 of the present invention. In this embodiment, the lower nest guy 21' is not fixed, and designed as a closed structure; it has the effect of folding the outer pipe 231'.

As shown in the FIG. 18, the upper nest inner chock 241' is provided with two pulleys: the upper nest pulley one 242' and the upper nest pulley two 243. Meanwhile, the middle pipe inner chock 2321' in the middle pipe 232' is provided with two pulleys: the pulley one 2322' and the pulley two 2323'. The lower nest is also provided with the lower nest pulley 271', and the lower nest guy 21' is wound on the lower nest pulley 271'. Then the guy is divided into two routes: The one route passes through the upper nest pulley one 242', the other passes through the upper nest pulley two 243'. Both routes are wound on the pulley one 2322' of the middle pipe inner chock 2321' and form a closed structure. The one end of the unfolding guy 22' is fixed on the bullet head 26' with the same method as shown in the FIG. 15. The other end passes through the pulley two 2323', is fixed on the lower part of the outer pipe 231'. The unfolding guy 22' can also be fixed on the upper part of the outer pipe 231', or is fixed on the upper nest 24' and on the upper nest inner chock 241'.

While unfolding the umbrella, due to the function of the unfolding spring 25', the middle pipe 232' is bounced open. Then, the pulley one 2322' and the pulley two 2323' move upward, thereby, making the unfolding guy 22' pull the outer pipe 231' open. Meanwhile, the distance between the outer pipe 231' and the pulley one 2322' changes, so the lower nest guy 21' pulls the lower nest 27' to move upwards, and achieves the unfolding status, as shown in FIG. 19.

While folding the umbrella, the bullet head 26' releases, and the pulling force of the unfolding guy 22' on the outer pipe 231' disappears. Because of the effect of the folding spring, the lower nest 27' moves downward. Due to the positional effect of the upper nest pulley one 242' and the upper nest pulley two 243', the lower nest guy 21' gives an acting force for the pulley one 2322' to move upward. But because the middle pipe 232' where the pulley one 2322' is located is supported by the unfolding spring 25', it generates counterforce on the outer pipe 231, thereby making the outer pipe 231' move downward, and realizes the effect of folding the outer pipe 231', as shown in FIG. 20;

In this method, although the lower nest guy is positioned through the two pulleys of the upper nest, it divides the lower nest guy into two routes and forms a closed structure, the application point is still located on the lower nest and the middle pipe, and in nature it has the same structure as shown in FIG. 1.

FIG. 21-FIG. 23 depict the method to realize folding two middle rod pipes through two guys according to the spirit of the present invention. It can be seen from the figure, the umbrella has four pipes: the outer pipe a3, the middle pipe one a31, the middle pipe two a32 and the inner pipe a33. The upper part of the middle pipe two a32 includes the middle pipe two inner chock a321, and the lower part of the middle pipe two inner chock a321 is embedded with the plastic sleeve a34. The upper part of the middle pipe one a31 has the middle pipe one inner chock a311. The inner chock a311 has three pulleys: the pulley one a312, the pulley two a313 and the pulley three a314. Meanwhile, the lower part of the middle pipe one a31 has the middle pipe pulley a315, and the lower part of the outer pipe a3 has the outer pipe pulley a301.

The umbrella has two guys: The one guy is the lower nest guy a1, and the other is the unfolding guy a2. The one end of the lower nest guy a1 is fixed on lower nest a7, and the other end bypasses the upper nest pulley a42 in the upper nest inner chock a41, and is fixed on and connected to inner chock a311 of the middle pipe one. The one end of the unfolding guy a2 is fixed on the middle pipe two inner chock a321, and then it is wound and tied on the bullet head pulley a61 in the tail of the bullet head a6. Then it is led out upward and in turn bypasses the pulley one a312, the outer pipe pulley a301, the pulley two a313, the pulley tree 314 and the middle pipe pulley a315, and then goes up and is fixed on the inner chock a321 of the middle pipe two. In which, after the unfolding guy a2 is fixed on the inner chock a321 of the middle pipe two, it is wound and tied on the bullet head pulley a61 through the plastic sleeve a34. Then it is wound and tied on the pulley one a312 through the plastic sleeve a34, and is wound on the outer pipe pulley a301 through the gap between the outer pipe a3 and the middle pipe one a31. It is then wound on the pulley two a313 and the pulley three a314 through the gap between the outer pipe a3 and the middle pipe one a 31, and is then wound on the middle pipe pulley a315 from the gap between the outer pipe a3 and the middle pipe one a31. Finally, it is wound out through the gap between the middle pipe one a31 and the middle pipe two a32, and is fixed on the inner chock a321 of the middle pipe two.

At this point, the unfolding spring a5 is provided only in the middle pipe two a32 and inner pipe a33, but it is not provided in the middle pipe one a31 and the outer pipe a3, so that the middle pipe one a31 and the outer pipe a3 can be folded while folding the umbrella.

As shown in FIG. 22, while unfolding the umbrella, the unfolding spring a5 opens, and it bounces out the middle pipe two a32. Because the bullet head a6 is stuck, the unfolding guy a2 pulls the middle pipe one a31 through the middle pipe pulley a315, and makes the middle pipe one a31 go up, and form the open status of the middle pipe one 132. Pulling the outer pipe a3 through the outer pipe pulley a301, makes the outer pipe a3 move up, and forms the open status of the outer pipe a3. Meanwhile, because the outer pipe a3 moves up, it makes the lower nest guy a1 also pull the lower nest a7 to move up, and forms the unfolding status.

While folding the umbrella, the bullet head a6 releases, and the pulling effect of the unfolding guy a2 on the outer pipe a3 middle pipe one a31 disappears. Due to the acting force of the folding spring, the umbrella ribs can drive the lower nest a7 to move downward. Because of the effect of the lower nest a7, the lower nest guy a1 drives the outer pipe a3 to be folded into the middle pipe one a31. Meanwhile, because the outer pipe pulley a301 moves, the unfolding guy a2 will drive the middle pipe pulley a315 to move upward through the pulley two a313 and the pulley three a314. Thereby, it gives a downward pulling force to the middle pipe one a31, and makes the middle pipe one a31 fold on the middle pipe two a32, as shown in FIG. 23;

FIG. 24-FIG. 26 depict another method to realize folding two middle rod pipes through two guys in the four-folded automatic unfolding and folding umbrella. It can be seen from the figure, that the umbrella has four pipes: the outer pipe b3, the middle pipe one b31, the middle pipe two b32 and the inner pipe b33. The upper nest b4 has the upper nest inner chock b41, and the upper nest inner chock b41 has the upper nest pulley b42. The middle pipe one b31 has the middle pipe one inner chock b311 at its upper part, and the inner chock b311 has the middle pipe pulley b312. The middle pipe two b32 has the middle pipe two inner chock b321 at its upper part, and the inner chock b321 has the pulley one b322 and the pulley two b323. The middle pipe two inner chock b321 has the plastic sleeve b34 at its lower part; meanwhile, the lower nest b7 has the lower nest pulley b71 at its upper part.

The umbrella has two guys: The one guy is the lower nest guy b1, and the other is the unfolding guy b2. The one end of the lower nest guy b1 is fixed on the upper nest b4. The other end bypasses the lower nest pulley b71 of the lower nest b7, and bypasses the upper nest pulley b42 in the upper nest inner chock b41, and bypasses the pulley one b322 provided in the middle pipe two b32. Finally it bypasses the middle pipe pulley b312 in the middle pipe one b31, and then it is fixed on and connected to the lower part of the outer pipe b3. The one end of the unfolding guy b2 is fixed on the bullet head b6, and then it is wound and tied on the pulley two b323 in the middle pipe two b32, and is led downward. Finally it is fixed at the lower part of the middle pipe one b31.

At this point, the unfolding spring b5 is provided only in the middle pipe two b32 and inner pipe b33, but it is not provided in the middle pipe one b31 and the outer pipe b3, so that the middle pipe one b31 and the outer pipe b3 can be folded while folding the umbrella.

As shown in FIG. 25, while unfolding the umbrella, the unfolding spring b5 opens, and it bounces out the middle pipe two b32. Because the bullet head b6 is stuck, the unfolding guy b2 pulls the middle pipe one b31, and makes the middle pipe one b31 go up, and form the open status of the middle pipe one b31. Meanwhile, because of the rising of the middle pipe one b31, it makes the distance between the middle pipe one b31 and the middle pipe two b32 increase. The lower nest guy b1 pulls the lower nest b7 to move up through the lower nest pulley b71; meanwhile it pulls the outer pipe b3 to move up, and forms the unfolding status;

While folding the umbrella, the bullet head b6 releases, and the pulling effect of the unfolding guy b2 on the middle pipe one b31 disappears. Under the acting force of the folding spring, the umbrella ribs can drive the lower nest b7 to move downward. Under the effect of the lower nest b7, the lower nest guy b1 pulls the middle pipe two b32 to move up through the pulley one b322. Because the middle pipe two b32 is supported by the unfolding spring b5, it has counteracting force on the lower nest guy b1. It makes the lower nest guy b1 drive the middle pipe one b31 and the outer pipe b3 to move down, thereby making the middle pipe one b31 and the outer pipe b3 become folded on the middle pipe two b32, as shown in the FIG. 26.

FIG. 27-FIG. 29 present a configuration with two guys for the three-folded automatic unfolding and folding umbrella in which the arrangement method of the lower nest guy c1 is the same as shown in the FIG. 3. Namely, the one end of the lower nest guy c1 is fixed on the lower nest c7. Then, it is wound and tied on the upper nest pulley c42 in the upper nest inner chock c41 through the outside of the outer pipe c3, and it is fixed on the upper part of the middle pipe inner chock c311 of the middle pipe c31 (the middle pipe c31 is provided with the middle pipe inner chock c311);

The middle pipe one c31 has the middle pipe one inner chock c311 at its upper part, and the inner chock c311 has two pulleys: the pulley one c312 and the pulley two c313. The lower part of the outer pipe c3 is provided with the outer pipe pulley c301.

The unfolding guy c2 is of a closed ring structure. One end is fastened on the bullet head pulley c61 at the tail section of bullet head c6, and is led out upward. Then, it is divided into two strands; one strand is wound and tied on the pulley one c312 of the middle pipe c31. After the unfolding guy c2 is led out of the middle pipe c31, it goes downward and bypasses the outer pipe pulley c301, and then it bypasses the pulley two c313, and goes downward to combine with the other strand. During the winding and tying process of the unfolding guy c2, the guys between the pulley one c312 and the outer pipe pulley c301, between the pulley two c313 and the outer pipe pulley c301 are positioned between the middle pipe c31 and the outer pipe c3. The guys between the bullet head pulley c61 and the pulley one c312, between the bullet head pulley c61 and the pulley two c313 are positioned in the plastics sleeve c33 of the middle pipe c31.

As shown in FIG. 28, while unfolding the umbrella, the unfolding spring c5 opens, and it bounces out the middle pipe two c31. Because the bullet head c6 is stuck, the unfolding guy c2 pulls the outer pipe c3 through the outer pipe pulley c301, and makes the outer pipe c3 go up, thus forming the open status of the outer pipe c3. Meanwhile, because of the rising of the outer pipe c3, it makes the distance between the outer pipe c3 and the middle pipe c31 increase. The lower nest guy c1 also pulls the lower nest c7 to move up, and forms the unfolding status;

While folding the umbrella, the bullet head c6 releases, and the pulling effect of the unfolding guy c2 on the outer pipe c3 disappears. Under the acting force of the folding spring, the umbrella ribs can drive lower nest c7 to move downward. Under the effect of the lower nest c7, the lower nest guy c1 generate the acting force which pulls the middle pipe c31 to move up. Because the middle pipe c31 is supported by the unfolding spring c5, it has counteracting force on the lower nest guy c1. It makes the lower nest guy c1 to drive the outer pipe c3. Thereby it makes the outer pipe c3 fold on the middle pipe two c31, as shown in the FIG. 29.

FIG. 30 includes the guy position schematic figures for folding two middle rod pipes in the four-folded automatic unfolding and folding umbrella using the present invention. As shown in the figure, the middle rod includes the outer pipe d31, the middle pipe one d32, the middle pipe two d33 and the inner pipe d34, in which, the lower part of the outer pipe d31 has the outer pipe pulley d301. The upper part of the middle pipe one d32 has the inner chock d321 of the middle pipe one, and the inner chock d321 has the middle pipe one pulley d322. The upper part of the middle pipe two d33 is provided with the middle pipe two inner chock d331, and the inner chock d331 is provided with the middle pipe two pulley d332, and the lower part of inner chock d331 is fixed with the plastic sleeve d35.

Unfolding spring d5 is provided in the inner pipe d34 and the middle pipe two d33, and is supported by the middle pipe two inner chock d331.

The upper nest inner chock d41 is provided in the upper nest d4, and the upper nest pulley d42 is provided in the upper nest inner chock d41.

The one end of the unfolding guy d2 is fixed on the bullet head d6, and then it is fixed on the lower part of the middle pipe one d32, after it is led out upward. It then passes through the plastic sleeve d35 and bypasses the middle pipe two pulley d332. An auxiliary line d21 is tied and provided on the unfolding guy d2. Auxiliary line d21 can link with and the unfolding guy d2, and generate the effect of opening the middle rod. The auxiliary line d21 is fixed on the middle pipe one inner chock d321 after it bypasses the middle pipe one pulley d322 and the outer pipe pulley d301. The auxiliary line d21 and the fixing section of the unfolding guy d2 are located below the middle pipe two inner chock d331, so as not to affect the function of the unfolding guy d2 and auxiliary line d21.

One end of the lower nest guy d1 is fixed on the lower nest d7, and it is led out upward, and pulled into the outer pipe d31 through the upper nest pulley d42. Then, it is led out downward, and is fixed on the middle pipe one inner chock d321.

As shown in FIG. 31, while unfolding the umbrella, the unfolding spring d5 is bounced open, and it bounces out the unfolding guy d2, it then pulls the middle pipe one d32 to move up. Meanwhile, the auxiliary line d21 pulls the outer pipe d31 to move up. Because the outer pipe d31 moves up, the lower nest guy d1 is pulled into the outer pipe d31, thereby generating acting force. The lower nest d7 is pulled by the lower nest guy d1 to move up, and it forms the unfolding status;

While folding the umbrella, the bullet head d6 releases, and the pulling effect of the unfolding guy d2 and the auxiliary line d21 on the middle pipe one d32 and the outer pipe d31 disappears. Due to the function of the folding spring, the lower nest d7 moves downward. Consequently, it makes the lower nest guy d1 and the middle pipe one d32 generate an upward force. The middle pipe one d32 has already been in the open status, so it cannot move upwards. Therefore, it has counteracting effect on the outer pipe d31, and makes the outer pipe d31 fold downward. When the outer pipe d31 fold downward, it generates a downward force on the middle pipe one d32 through auxiliary line d21, and makes the middle pipe one d32 fold, too. Thus, it forms the effect of folding two middle rod pipes during the folding umbrella process.

In conclusion, all the embodiments above pull and open all of pipes of the middle rod through at least one guy during the process of unfolding the umbrella. During the umbrella folding process, after the spreading component releases, middle rods are folded at least through one guy. Regardless of how the lower nest guy and the unfolding guy are wound and passed through various components in the middle rods, the upper nest or lower nest, the main function of the lower nest guy is to realize the folding of the middle rod pipes. If necessary, the lower nest guy also has the auxiliary function of pulling the middle rod pipes open. Likewise, the unfolding guy is mainly used to unfold and pull the middle rod pipes open. If necessary, the unfolding guy also has the auxiliary function of folding the middle rod pipes.

Because the guys have pulling effects during the automatic unfolding and folding process, The guys, including the lower nest guy, the middle pipe guy and the unfolding guy, can be made of metal wire, plastic wire, nylon wire or any other wires with certain strength. But one of the basic requirements for the guys is to have sufficient strength, so that the pulling effects and coordination are smooth during the process of umbrella use.

All the above is provided as several preferred embodiments to explain the present invention, and shall not be used to limit the range of the present invention. Variations and modifications can be made within the purposes, effects and schemes of the present invention and shall be within the protection area of the present invention.

What is claimed is:

1. A guy structure of an automatic unfolding and folding umbrella comprising an upper nest, a lower nest, a middle rod including at least one middle rod pipe, and a spreading component controlling the unfolding and folding umbrella, the guy structure comprising at least two guys comprising a lower nest guy and an unfolding guy, wherein:

a first end of the lower nest guy is at least connected to the lower nest, and the lower nest guy is wound and tied to the upper nest, wherein a second end of the lower nest guy is at least connected to the middle rod pipe to be collected; and a first end of the unfolding guy is at least connected to the spreading component, and a second end of the unfolding guy is connected to at least one of the middle rod and the upper nest.

2. The guy structure of the automatic unfolding and folding umbrella of claim 1, wherein:

the first end of the lower nest guy is connected to the lower nest, and the second end of the lower nest guy is moved upward bypassing the upper nest and is connected to the middle rod pipe which is movable relative to the upper nest;

the umbrella further comprises an unfolding spring which is provided below a fixing section of the lower nest guy and the middle rod pipe; and the first end of the unfolding guy is connected to the spreading component, and the unfolding guy goes upward through a joint of the middle rod, and the second end of the unfolding guy is connected to the at least one middle rod pipe above a fixing position of the lower nest guy.

3. The guy structure of the automatic unfolding and folding umbrella of claim 1, wherein the middle rod pipe to be collected is provided with an inner chock on an upper part of the middle rod pipe, the inner chock fixes at least one of the lower nest guy and the unfolding guy, and the inner chock is provided with a pulley for the winding and tying of the lower nest guy or the unfolding guy.

4. The guy structure of the automatic unfolding and folding umbrella of claim 2, wherein:

the middle rod comprises a first pipe first from the middle rod's top and a second pipe second from the middle rod's top, the second end of the lower nest guy is fixed to the second pipe of the middle rod; and the first end of the unfolding guy is fixed on the spreading component, the second end of the unfolding guy is fixed on at least one of the first pipe of the middle rod and the upper nest, and the unfolding guy is wound and tied on the middle rod.

5. The guy structure of the automatic unfolding and folding umbrella of claim 2, wherein:

the middle rod comprises an external pipe which is fixed with the upper nest, and the first end of the lower nest guy stretches out after it is connected on the lower nest and is fixed on the upper nest or on the external pipe of the middle rod; and the second end of the lower nest guy stretches out after it is connected to the middle rod pipe which can move relative to the upper nest, and is fixed on the upper nest or on the external pipe of the middle rod.

6. The guy structure of the automatic unfolding and folding umbrella of claim 2, wherein:

the umbrella comprises first, second, third and fourth pipes, a first lower nest guy, and a second lower nest guy;

one end of the first lower nest guy is fixed on the lower nest, and the other end of the lower nest guy is fixed on the upper part of the second pipe after winding and tying through the upper nest; and one end of the second lower nest guy is fixed below the first pipe, and the other end is connected on the upper part of the third pipe after winding and tying through the second pipe top.

7. The guy structure of the automatic unfolding and folding umbrella of claim 1, wherein:

the middle rod comprises a first pipe first from the top of the middle rod and a second pipe second from the top of the middle rod, the second end of the lower nest guy is fixed on the second pipe of the middle rod; and the first end of the unfolding guy is fixed on the spreading component, the second end of the unfolding guy is connected to the first pipe of the middle rod then fixed on the second pipe, and the unfolding guy is wound and tied on the middle rod.

8. The guy structure of the automatic unfolding and folding umbrella of claim 1 wherein:

the middle rod comprises a first pipe first from the middle rod top, a second pipe second from the middle rod top, and a third pipe third from the middle rod top;

the first end of the lower nest guy is fixed on the lower nest, and the second end of the lower nest guy is fixed on and connected to the second pipe of the middle rod after bypassing the upper nest; and the first end of the unfolding guy is fixed on the third pipe of the middle rod, the unfolding guy is led out upward after winding and tying a bullet head, and the unfolding guy bypasses in turn the second pipe of the middle rod, the first pipe of the middle rod, and the second pipe of the middle rod, and the second end of the unfolding guy is fixed on the third pipe of the middle rod.

9. The guy structure of the automatic unfolding and folding umbrella of claim 1 wherein:

the middle rod comprises a first pipe first from the middle rod top, a second pipe second from the middle rod top, and a third pipe third from the middle rod top;

the first end of the lower nest guy is fixed on the upper nest, and the second end of the lower nest guy bypasses the lower nest, the upper nest, the third pipe of the middle rod, and the second pipe of the middle rod, and then the second end of the lower nest guy is fixed on and connected to the first pipe of the middle rod; and the first end of the unfolding guy is fixed on a bullet head, and the unfolding guy is wound and tied on the third pipe of the middle rod and led out downward and fixed on the second pipe of the middle rod.

10. The guy structure of the automatic unfolding and folding umbrella of claim 1 wherein the lower nest guy and the unfolding guy is made of at least one of metal wire, plastic wire, nylon wire.

11. The automatic unfolding and folding umbrella of claim 1, further comprising:

umbrella ribs, the upper nest connected to the middle rod and connected to the lower nest by the umbrella ribs; and a pulley connected to the upper nest, wherein the first guy is connectedly wound on the middle rod via the pulley.

12. The automatic unfolding and folding umbrella of claim 1, wherein the spreading component comprises a bullet head slideable within the middle rod.

13. The automatic unfolding and folding umbrella of claim 1, wherein the spreading component comprises an elastic windlass.

14. The automatic unfolding and folding umbrella of claim 1, further comprising a spring connected to the middle rod for slideably extending the plurality of slideably connected pipes.

* * * * *